United States Patent [19]

Daenen et al.

[11] 4,381,975

[45] May 3, 1983

[54] ALUMINIUM ELECTROPLATING SOLUTION

[75] Inventors: Theo E. G. Daenen; Gerardus A. R. van Dijk; Steven A. Stolk, all of Eindhoven, Netherlands

[73] Assignee: U.S. Philips Corporation, New York, N.Y.

[21] Appl. No.: 339,933

[22] Filed: Jan. 18, 1982

[30] Foreign Application Priority Data

Feb. 6, 1981 [NL] Netherlands ..... 8100569

[51] Int. Cl.[3] ..... C25D 3/44

[52] U.S. Cl. ..... 204/14 N

[58] Field of Search ..... 204/14 N, 39

[56] References Cited

U.S. PATENT DOCUMENTS 3,595,760 7/1971 Ishibashi ..... 204/14 N

OTHER PUBLICATIONS

Journal of Applied Electrochemistry 3, No. 4, (1973), 321–325.

*Primary Examiner*—T. M. Tufariello

*Attorney, Agent, or Firm*—Norman N. Spain

[57] ABSTRACT

Electrolyte liquid for the electrodeposition of aluminium, containing lithium hydride and/or lithium aluminium hydride and at least one aluminium halide dissolved in tetrahydrofuran or halogen and/or methyl derivatives, the molar ratio between the Al-halide and the lithium aluminium hydride being in excess of 3. In addition, this bath contains an alkali metal aluminium chloride. This liquid is conspicuous for its high conductivity and its great stability.

7 Claims, No Drawings

ALUMINIUM ELECTROPLATING SOLUTION

The invention relates to an electrolyte liquid for the electrodeposition of ductile aluminum on an electrically conductive substrate, the method of electrodepositing ductile aluminum on a substrate and to the products thus obtained.

DE-PS No. 17 71 116 describes such a liquid, which contains lithium hydride and/or lithium aluminum hydride and at least one halide, dissolved in tetrahydrofuran or halogen and/or methyl derivatives thereof. The tetrahydrofuran derivatives comprise 2,3-dichlorotetrahydrofuran, 2-methyl,3-chlorotetrahydrofuran, 3-bromotetrahydrofuran, 2-methyltetrahydrofuran and 2-dimethyltetrahydrofuran. The condition that $1 \leqq n \leqq 3$, wherein $$n=(X-\tfrac{1}{3}Z)/(Y+\tfrac{1}{3}Z)$$

must be satisfied.

In this equation

X is the total number of moles of dissolved aluminum halide

Y is the total number of moles of dissolved lithium aluminum hydride, and

Z is the total number of moles of dissolved lithium hydride.

These liquids have however a poor stability, the tetrahydrofuran or the derivatives thereof being converted into butanol. In addition, they have a poor conductivity which becomes even poorer at values of n above 3.

It is an object of the invention to provide an electrolyte liquid which does not have the disadvantages mentioned in the foregoing.

According to the invention it has now surprisingly been found that a particularly stable bath having a high conductivity can be obtained at a value of n, as defined above, which exceeds 3, when the bath furthermore contains an effective quantity exceeding 0.35 moles/l of an alkali metal aluminum chloride. Preferably the alkali metal aluminum is present in the bath in a quantity between 0.37 and 0.6 moles/l.

It is advantageous to add lithium aluminum chloride to the electrolyte liquid, but also sodium or potassium aluminum chloride may be used.

In accordance with a preferred embodiment of the invented liquid for the electrodeposition of aluminum the quantity n has a value between 4 and 5.5.

Preferably, the bath in accordance with the invention is prepared by adding the lithium aluminum chloride in the form of a solid crystalline compound $LiAlCl_4.mTHF$ (THF=tetrahydrofuran), wherein m may have the values 2, 4 or 8.

However, when preparing the liquid, LiCl may alternatively be used which thereafter reacts with the $AlCl_3$ present, forming $LiAlCl_4$. The quantity of $AlCl_3$ must then of course be adapted to the LiCl added.

The improved conductivity of the plating solutions relative to the prior art solutions has great advantages. The ohmic decay in the solution during electrolysis is decreased and consequently the bath is heated to a lesser extent. Thus the electric efficiency is improved.

In addition, an improved secondary current line distribution is obtained, as a result of which the growth of the electrodeposit is more uniform than with liquids having a lower conductivity.

The invention will now be further explained on the basis of the following examples.

EXAMPLE 1

0.2 mole of $LiAlH_4$ and 1.04 mole of anhydrous $AlCl_3$ are added to 1 l of anhydrous tetrahydrofuran. The quantity n, as previously defined, is 5.20.

In a separate vessel, $AlCl_3.2THF$ and LiCl are reacted in equimolar ratios under argon, the compound $LiAlCl_4.2THF$ being formed in solution. This mixture is dissolved in the above-mentioned $LiAlH_4$-$AlCl_3$ solution in such a quantity that the $Li^+$-concentration amounts to 0.8 mole/liter. The specific conductivity $\chi$ of the solution is 10.2 $mScm^{-1}$. The bath voltage at a current density of 1 $A/dm^2$ is 1.2 V. This means that the heat generated in the bath in proportion to the bath voltage is less than the heat generated in the first-mentioned solution. A good aluminum deposit is obtained up to 6 $A/dm^2$. This bath has such a stability that after 3 months none of its activity has been lost. A bath containing 0.55 mole of $LiAlH_4$ and 1 mole of $AlCl_3$ in 1 l of tetrahydrofuran ($n \doteq 1.8$) became inactive after 2 months.

EXAMPLE 2

0.3 mole of $LiAlH_4$ and 1.08 mole of $AlCl_3$ are added to 1 l of anhydrous tetrahydrofuran ($n=3.60$). The specific conductivity ($\chi$) of this solution is 7.6 $mScm^{-1}$.

Anhydrous LiCl is added to this solution up to a concentration of 0.49 mole/l, the compound $LiAlCl_4$ being formed in solution. The specific conductivity then becomes 9.4 $mScm^{-1}$. The bath voltage is a current density of 1 $A/dm^2$ is 1.36 V. Good ductile aluminum can be deposited up to a current density of $5/dm^2$.

Also this bath has kept its full activity after 3 months.

EXAMPLE 3

0.2 mole of $LiAlH_4$ and 1.1 mole of $AlCl_3$ are added to 1 l of anhydrous tetrahydrofuran under argon ($n=5.5$). 0.8 mole of $LiAlCl_4.8THF$ is added thereto. The specific conductivity $\chi$ of the solution is 8.7 $mScm^{-1}$. The bath voltage at a current density of 1 $A/dm^2$ is 1.4 V. Good aluminum can be deposited up to 5 $A/dm^2$. After 4 months the bath still produces good aluminum layers.

EXAMPLE 4

0.2 mole of $LiAlH_4$ and 0.7 mole of $AlCl_3$ are added to 1 l of anhydrous tetrahydrofuran under argon ($n=3.5$). In a separate vessel $AlCl_3.2THF$ and LiCl are combined in equimolar ratios under argon, the compound $LiAlCl_4.2THF$ being formed in solution. This mixture is dissolved in the above-mentioned $LiAlH_4$-$AlCl_3$ solution, in such a quantity that the total $Li^+$-concentration amounts to 0.8 mole/liter. The specific conductivity of the solution is 11.5 $mScm^{-1}$. The bath voltage at a current density of 1 $A/dm^2$ is 1.1 V. Good aluminum can be deposited up to 5 $A/dm^2$. This bath maintains its proper activity for at least 4 months.

EXAMPLE 5

0.08 mole of $LiAlH_4$ and 1.05 mole of $AlCl_3$ are added to 1 l of anhydrous tetrahydrofuran under argon ($n=13.1$). In a separate vessel $AlCl_3.2THF$ and LiCl are joined in equimolar ratios under argon, the compound $LiAlCl_4.2THF$ being formed in the solution. This mixture is dissolved in the above-mentioned $LiAlH_4$-$AlCl_3$-mixture in such a quantity that the total $Li^+$-concentration is 0.5 mole/liter. The specific conductivity is: 9.5 $mScm^{-1}$. The bath voltage at a current density of 1 $A/dm^2$ is 1.3 V. Good aluminum can be deposited up to 4 $A/dm^2$. The bath maintains its activity for at least 4 months.

EXAMPLE 6

0.08 mole of $LiAlH_4$ and 0.85 mole of $AlCl_3$ are added to 1 l of anhydrous tetrahydrofuran under argon (n=10.6). In a separate vessel LiCl and $AlCl_3.2THF$ are joined in equimolar ratios under argon, the compound $LiAlCl_4.2THF$ being formed in the solution. This mixture is dissolved in the above-mentioned solution in such a quantity that the total $Li^+$-concentration is 0.45 mole/liter. The specific conductivity of the solution is: 9.0 $mScm^{-1}$. The bath voltage at a current density of 1 $A/dm^2$ is 1.35 V. Good aluminum can be deposited up to 7 $A/dm^2$. The bath is capable of depositing good aluminum for at least 3 months.

What is claimed is:

1. An electrolyte bath for the electrodeposition of ductile aluminum on a substrate, containing lithium hydride and/or lithium aluminum hydride and at least one aluminum halide, dissolved in tetrahydrofuran or halogen and/or methyl derivatives thereof, characterized in that n, defined as $$n=(X-\tfrac{1}{4}Z)/(Y+\tfrac{1}{4}Z)$$

wherein

X is the total number of moles of dissolved aluminum halide,

Y is the total number of moles of dissolved lithium aluminum hydride,

Z is the total number of moles of lithium hydride, is greater than 3 and an effective quantity exceeding 0.35 moles/l of alkali metal aluminum chloride is added to the bath.

2. An electrolyte bath as claimed in claim 1, characterized in that the alkali metal aluminum chloride is added to the bath in an quantity between 0.37 and 0.6 moles/l.

3. An electrolyte bath as claimed in claim 1 or 2, characterized in that lithium aluminum chloride is added to the bath.

4. An electrolyte bath as claimed in claim 1, characterized in that n has a value between 4 and 5.5.

5. A method of preparing an electrolyte bath as claimed in claim 1, characterized in that the alkali aluminum chloride is added in the form of crystalline compound $LiAlCl_4.mTHF$, wherein m has the value 2, 4 or 8.

6. A method of electrodepositing ductile aluminum on an electrically conducting substrate comprising using an electrolyte liquid as claimed in claim 1.

7. A substrate provided with a layer of ductile aluminum obtained by means of the method claimed in claim 6.

* * * * *